United States Patent [19]

Iwashita

[11] Patent Number: 4,458,614

[45] Date of Patent: Jul. 10, 1984

[54] SEWING MACHINE NEEDLE

[75] Inventor: Takeshi Iwashita, Ueda, Japan

[73] Assignee: Organ Needle Co. Ltd., Japan

[21] Appl. No.: 338,167

[22] Filed: Jan. 8, 1982

[51] Int. Cl.[3] ..... D05B 85/02

[52] U.S. Cl. ..... 112/222; 112/182

[58] Field of Search ..... 112/222, 182; 223/102; 163/5

[56] References Cited

U.S. PATENT DOCUMENTS

| | | | |
|---|---|---|---|
| 3,929,082 | 12/1975 | Zocher | 112/222 |
| 3,954,072 | 5/1976 | Zocher | 112/222 |
| 4,194,457 | 3/1980 | Parsons | 112/222 |

FOREIGN PATENT DOCUMENTS

| | | | |
|---|---|---|---|
| 3027534 | 8/1982 | Fed. Rep. of Germany | 112/222 |

*Primary Examiner*—Henry Jaudon
*Assistant Examiner*—Andrew M. Falik
*Attorney, Agent, or Firm*—Steinberg & Raskin

[57] ABSTRACT

A sewing machine needle has a chamfer portion formed in its shaft which defines an interspace between the needle shaft and a thread running in an upward direction parallel to the needle shaft to permit a thread loop catching device to enter into the interspace during machine operation. The chamfer portion is formed by a portion of the needle shaft which is displaced with respect to the axis of the needle which extends substantially parallel thereto and yet which has substantially the same transverse cross-section as other portions of the shaft and by shaft transition portions which adjoin the displaced shaft portion which extend at an angle with respect to the needle axis. In this manner, a deep chamfer portion is obtained so as to increase the interspace between the needle shaft and sewing thread so that a reliable engagement of the sewing thread by the thread loop catching device can be achieved without the necessity of a so-called loop stroke. Moreover, sufficient resistance to buckling of the needle is achieved despite the increase in depth of the chamfer portion.

14 Claims, 16 Drawing Figures

FIG. 3
PRIOR ART
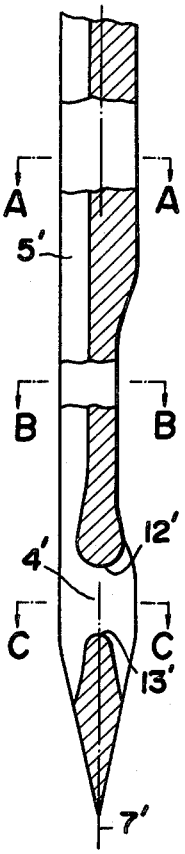
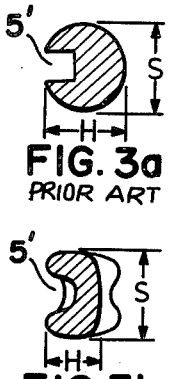
FIG. 3a
PRIOR ART
FIG. 3b
PRIOR ART
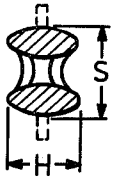
FIG. 3c
PRIOR ART
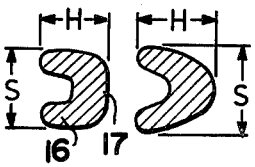
FIG. 4a a'
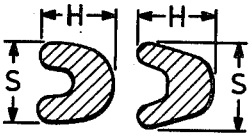
FIG. 4b b'
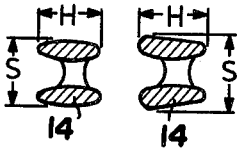
FIG. 4c c'
FIG. 4
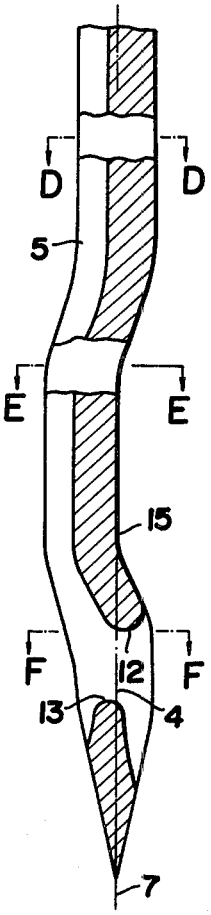

FIG. 7
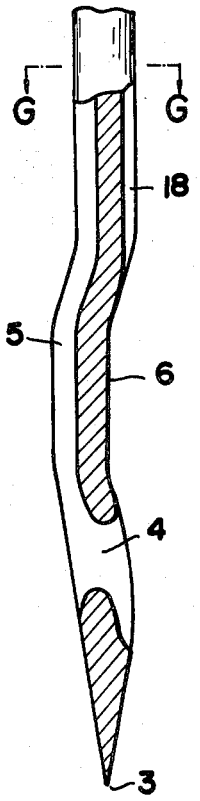
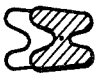
FIG. 8a
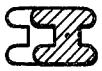
FIG. 8b
FIG. 9
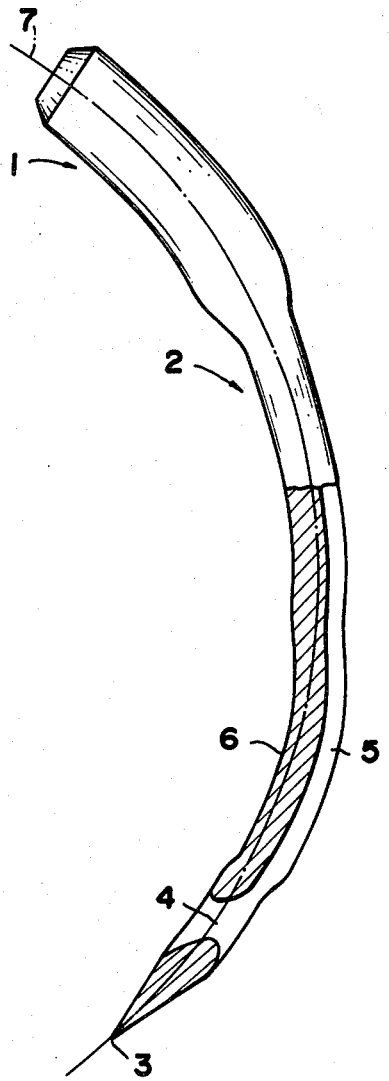

SEWING MACHINE NEEDLE

BACKGROUND OF THE INVENTION

This invention relates generally to the construction of sewing machine needles of the type having a butt or clamping portion and an adjoining shank or shaft which terminates in a a point above which an eye is formed, and more particularly to a sewing machine needle of this type wherein a long, thread-guiding channel is formed in one side of the shaft which opens into the needle eye and which also has a cutout portion or chamfer formed in the shank above the eye on the side of the needle shaft opposite to the side in which the thread-guiding channel is formed. Sewing machine needles of this type are known and reference is made in this connection to U.S. Pat. No. 4,037,641.

Generally, a sewing machine needle functions as both a tool and as a thread-guiding element and must penetrate during its life a variety of materials to form millions of stitches transporting the needle thread to the thread loop catching device within a predetermined time and over a certain movement path, so that the thread can be gripped or caught to achieve the necessary interlacing and completion of the sewing cycles.

The materials sewn using such needles are in general conventional textile fabrics which may be textured, knitted materials from natural or synthetic fibers for clothing and lingerie, as well as leather, artificial leather or other synthetic laminated material used in the clothing and shoe industry. Moreover, other types of materials, such as paper, cardboard, synthetic foils, textures, meshes, and fleeces formed of glass, steel and asbestos fibers as well as a multitude of other materials in various combinations and designs can be sewn together by seams on sewing machines by means of needles and needle threads. The reliability and quality of the sewn seams are at least in part determined by the specific characteristics of the materials being sewn. In this connection, the elasticity and resistance to puncturing or penetration of the material being sewn often has a critical influence on the efficacy of the seam.

The most frequently used sewing machine needles for backstitching and chain-stitching machines generally include a shaft terminating at a point with an eye formed therethrough and in which a cutout or chamfer portion is formed above the eye to define an interspace between the needle shaft and a needle thread which runs in an upward direction parallel to the needle shaft, which interspace receives a thread catching device during operation of the machine. In conventional needle construction, depth of the chamfer portion is generally only about 25% of the nominal shaft diameter so that the interspace defined by the chamfer portion alone is not sufficient to assure a reliable penetration of the thread catching device. Moreover, the resistance to buckling of a sewing machine needle of this type is reduced by about 40% as compared to a needle which does not have a cutout or chamfer portion. Accordingly, in order to provide sufficient needle rigidity, especially in the case where the needle is used with a material having a high resistance to penetration, it is often necessary to use heavier needles than would otherwise be required by the thickness of the needle thread.

Conventional sewing needles often have an elongate thread-guiding channel formed therein which merge to the needle eye in which the needle thread runs during machine operation. However, due to production and technical reasons, the depth of the thread-guiding channel in the region directly above the needle eye is generally reduced so that the sewing thread is insufficiently protected at that region.

Moreover, in sewing machine needles which are currently formed using stamping techniques, the depth of chamfer portion is limited for technological reasons to a maximum of 30% of the nominal shaft diameter.

For the above reasons, a thread which is guided through a conventional sewing machine needle and which abuts the needle in a taut condition can be gripped or caught by the thread-catching device with only the greatest unreliability, especially when the needles are below Nm90. In other words, the interspace defined between the needle shaft and the needle thread by the cutout or chamfer portion is by itself insufficient to insure a reliable gripping by the thread-catching device. Accordingly, the space in which the thread-catching device is received must be enlarged through the formation of a loop which occurs during the lifting stroke of the needle. More particularly, after the needle has reached its lower dead center position it begins an upward stroke corresponding to a certain crank angle of the drive shaft. In this manner, a loop is formed at the needle whose size is determined at the angle through which the crank rotates during the upward stroke and thereby creating an interspace of a varying magnitude. For example, the interspace will remain relatively small if a highly elastic sewing thread is used in the sewing operation.

However, the angle through which the crank rotates during the loop formation step is relatively small and always occurs after the needle has reached the bottom dead center position of its stroke. These conditions impose severe limits on the construction and coupling of the mechanical functions of the machine which are determined by the kinematics of the sewing thread.

The production techniques presently utilized in the construction of conventional sewing machine needles in which cutout or chamfer portions are produced is constituted by a stamping process which necessarily results in the formation of burrs. Such techniques increase the number of necessary operations thereby increasing production costs as well as material losses whereby the quality of the needle is often insufficient.

SUMMARY OF THE INVENTION

Accordingly, one object of the present invention is to provide a new and improved sewing machine needle having a deeper cutout or chamfer portion and yet which has sufficient resistance to buckling, thereby increasing the interspace between the needle shaft and the sewing thread.

Another object of the present invention is to provide a new and improved sewing machine needle of the above-mentioned type in which the thread-guiding channel has a greater depth in the area where it merges into the needle eye so that the needle thread is completely protected in that region.

Briefly, in accordance with the present invention, these and other objects are attained by providing a sewing machine needle including a shank or shaft in which a chamfer portion is formed and wherein the chamfer portion is defined by a portion of the shaft situated above the needle eye and which is laterally displaced with respect to the axis of the needle and which extends substantially parallel to the needle axis and wherein the displaced shaft portion has substantially the same transverse cross-sectional configuration as other portions of the shaft. Shaft transition portions adjoin the displaced shaft portion and are inclined towards the needle axis.

A sewing machine needle constructed in accordance with the present invention results in an enlargement of the interspace between the needle shaft and the sewing thread such that the sewing thread can be gripped by the thread-catching device in a dependable and reliable manner even without the so-called loop or lifting stroke. It has been surprisingly found that the displacement of the chamfer portion forming shaft portion, which abuts directly on the needle eye, by about 50%, for example, of the nominal shaft diameter or shaft thickness will cause the buckling resistance of the needle to decrease to a lesser extent than the decrease in buckling resistance resulting in conventional needle constructions by cutouts or chamfer portions having a depth of only 25% of the nominal shaft diameter.

In a preferred embodiment of the invention, the amount of displacement of the displaced portion corresponds to about 30% to 60% of the shaft thickness and the longitudinal center lines of the transition portions extend at an angle of less than about 30° to the needle axis. The longitudinal center line of the transition portion adjoining the needle eye preferably extends at an angle of between about 10° and 30° with respect to the needle axis while the longitudinal center line of the upper transition portion extends at an angle of between about 5° and 20° to the needle axis. It has been discovered that no difficulties arise when transition portions with such inclinations or slopes are utilized even at relatively great sewing speeds and that the puncture holes formed in the material being sewn are hardly enlarged, even when such material is relatively inflexible or tough.

As a result of the needle according to the present invention described above, a thread-guiding channel formed on the side of the needle shaft opposite to the side in which the chamfer portion is formed can have a constant depth and yet become deeper at the lower transition portion of the shaft up to the region where the channel merges with the needle eye. This feature advantageously provides a reliable protection for the thread even at the region where the thread-guiding channel merges into the needle eye.

According to the present invention, a rounded upper flange defining the top of the needle eye is somewhat displaced in the direction of a side of the needle shaft in which the chamfer portion is formed, i.e., towards the thread-catching device. This results in an improvement of the guidance of the thread as well as an increase in the interspace between the thread and the shaft.

The upper flange forming the top of the eye as well as the lower end of the thread-guiding channel is shaped in a manner such that it forms, together with a lower flange forming the lower side of the needle eye, a channel which reduces the extent to which the needle thread is deflected in the direction of the needle axis during machine operation.

Further in accordance with the present invention, the sewing machine needle including its pre-formed eye, is produced utilizing an extrusion molding technique, without burr formation and using a blank with specially designed tools whereby the cross-section of the shaft is either V- or U-shaped and whereby the angular position of the side walls along the length of the shaft, including the eye, may be either constant or variable. The molded V- or U-shaped shaft profiles will therefore have no interruptions in the fibers in the cross-section of the material as would otherwise occur in other methods of construction, such as free cutting methods. Accordingly, this method of construction advantageously contributes to the increase of the rigidity of the needle.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which:

FIG. 3 is a side elevation view in section of the shaft of the prior art needle illustrated in FIG. 1;

FIGS. 3*a*–3*c* are sectional views taken along lines A—A, B—B and C—C in FIG. 3;

FIG. 4 is a side elevation view section of the shaft of a needle in accordance with the present invention illustrated in FIG. 2;

FIGS. 4*a*–4*c* are sectional views taken along lines D—D, E—E and F—F of FIG. 4;

FIGS. 4*a*'–4*c* ' are sectional views similar to those illustrated in FIGS. 4*a*–4*c* and illustrating a V-shaped cross-section of a needle in accordance with the present invention;

FIG. 7 is a side elevation view in section of a needle shaft of a second embodiment of a needle according to the present invention having a second thread-guiding channel;

FIG. 8*a* is a section view taken along line G—G of FIG. 7;

FIG. 8*b* is a view similar to FIG. 8*a* and illustrating a modified embodiment thereof; and FIG. 9 is a side elevation view in partial section of yet another embodiment of a sewing machine needle constructed in accordance with the present invention and having an arcuate needle axis.

DESCRIPTION OF PREFERRED EMBODIMENTS

Figure 1:
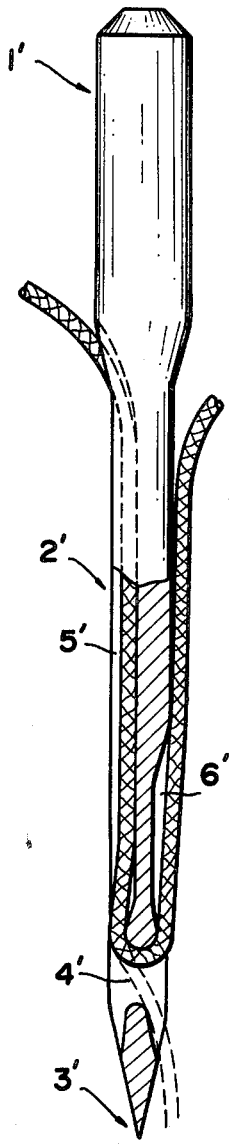
FIG. 1 PRIOR ART
FIG. 1 is a side elevation view in partial section of a prior art sewing needle and a pre-stressed needle thread associated therewith.

Referring now to the drawings wherein like reference characters designate identical or corresponding parts throughout the several views, and more particularly to FIGS. 1 and 3, a conventional sewing machine needle such as that disclosed in U.S. Pat. No. 4,037,641, is illustrated of the type which is used in home sewing machines as well as in industrial machines. Such sewing machine needles are generally manufactured utilizing a stamping process which results in the formation of burrs. The prior art sewing needle has an upper clamping or butt portion 1' and an adjoining shank or shaft 2' integrally connected to and extending from an end of the butt portion 1'. The shaft 2' terminates in a needle point 3' and has an eye 4' formed therethrough above the point. In order to protect the needle thread during the stitching of the goods being sewn, a thread-guiding channel 5' is formed on one side of the shaft 2' which merges at its lower end into the eye 4'. On the side of shaft 2' opposite to the side in which the thread-guiding channel 5' is formed, a cutout or chamfer portion 6' is formed above the eye 4'. As seen in FIG. 1, the chamfer portion 6' defines a free space or interspace between the shaft 2' and a relatively taut needle thread.

In conventional sewing machine needles of the type illustrated in FIGS. 1 and 3, the chamfer portion 6' as well as the eye 4' is stamped into the shaft 2' by means of a burr-producing stamping operation. During this process, material from the shaft is forced from the subsequently formed chamfer portion 6' into two lateral burrs situated on a center line of the needle shaft, such as is shown by the dash lines in FIGS. 3*b* and 3*c*. These burrs are ground down after the needle has been removed from the stamping mold. Thus, the material volume of the needle shaft is reduced by the volume of the lateral burrs in the region of the chamfer portions 6'. Moreover, the cross-section of the shaft is significantly flattened and reduced in the area of chamfer portion 6' thereby significantly reducing the resistance to buckling of the prior art needle 1'.

The sewing machine needle and associated needle thread are illustrated in FIG. 1 during the puncturing operation and with the needle 1' reaching the dead center position. The protection of the sewing thread afforded by the thread-guiding channel 5' of the prior art needle 1' has proven to be insufficient, particularly in the case of heavier sewing threads. Similarly, the free space or interspace between the needle shaft 2' and the sewing thread, provided by the chamfer portion 6', is too small to allow a reliable gripping of the thread by the thread-catching device without additional widening of the thread loop through the loop forming stroke.

Still referring to FIGS. 1 and 3, the depth of the thread-guiding channel 5' at the point where it merges into the eye 4' is greatly reduced for production and technical reasons. Accordingly, protection of the thread and especially of somewhat heavier sewing threads, is not assured in this region when stitching holes are formed. Thus, during the puncturing of the material, it is possible that sensitive, texturized materials may be torn or that a sewing thread having low rigidity will be sheared as a result of a portion of the sewing thread projecting outwardly from the outer contour of the needle shaft 2'. Moreover, a cutting or milling of the thread-guiding channel 5' so as to have a constant depth is not possible since this would result in the formation of a sharp edge at the point where the thread-guiding channel 5' merges into the eye 4' prior to the return or deflection of the thread around the upper flange 12' (FIG. 3) of needle eye 4' with consequent damage to the needle thread from such a sharp edge. Moreover, it is not feasible to machine finish such a sharp edge for economic reasons.

Furthermore, it is not possible due to the stamping technique utilized in the manufacture of the prior art needle to have the thread-guiding channel 5' merge into the needle eye 4' with a constant depth greater than the diameter of the thread in the region of the eye 4' and of the chamfer portion 6' which has been stamped into the needle shaft by the burr-producing stamping process.

The guidance and formation of the thread loop is accomplished in part by the flange 12' which constitutes the upper side of the eye 4'. The lifting and supporting of the thread loop is accomplished in part by a flange 13' which forms the lower side of eye 4' proximate to the needle point 3'. Thus, flanges 12' and 13', together with the side walls, define the needle eye 4' and are arranged symmetrically with respect to the needle axis 7'. This construction contributes to the fact that a thread loop 20' (FIG. 5) is formed on both sides of the eye 4' when the needle is lifted from its bottom dead center position.

Figure 2:
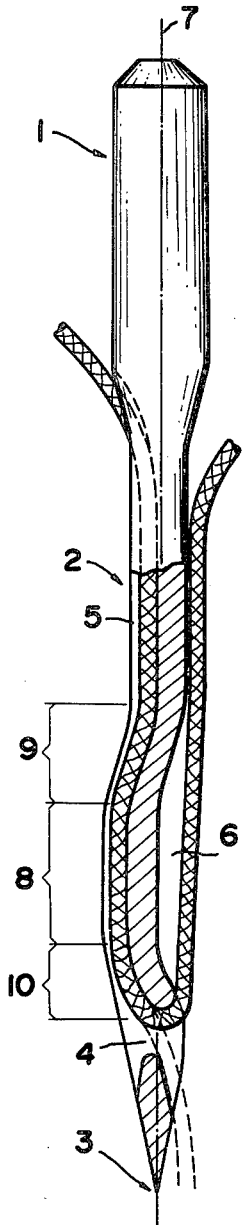
FIG. 2 is a view similar to FIG. 1 and illustrating a sewing needle according to the present invention.

To facilitate a direct comparison with the conventional sewing machine needle illustrated in FIGS. 1 and 3, a sewing machine needle constructed in accordance with the present invention is illustrated in FIGS. 2 and 4. As in the case of the conventional needle 1', the needle 1 of the present invention includes a clamping or butt portion 1 and an adjoining shank or shaft 2 which terminates in a needle point 3 at its free end. An eye 4 is formed through the shaft 2 above the needle point 3 into which a thread-guiding channel 5, formed within the shaft 2, merges. A cutout or chamfer portion 6 is formed on the side of shaft 2 opposite to the side in which the thread-guiding channel 5 is formed.

According to the invention, the chamfer portion 6 is defined by a portion 8 of shaft 2 situated above the needle eye 4 which is laterally displaced with respect to the needle axis 7 which extends substantially parallel thereto. The displaced shaft portion 8 has substantially the same transverse cross-sectional configuration as other portions of shaft 2 above needle eye 4 as best seen in FIGS. 4*a* and 4*b*.

A pair of upper and lower transition portions 9 and 10 are formed in shaft 2 which are inclined towards the needle axis 7. Thus, the lower shaft transition portion 10 extends between the region of the needle eye 4 and the lower end of the displaced shaft portion 8 while the upper shaft transition portion 9 extends between the main portion of shaft 2 and the upper end of the displaced shaft portion 8. It has been found that the resistance moment in the displaced shaft portion 8 as well as in the shaft transition portions 9 and 10, is essentially equal to the resistance moment in the region of shaft 2 which adjoins the insertion or butt portion 1 of the needle. Thus, the sewing machine needle manufactured according to the present invention provides complete protection and free mobility for the tightening of the needle thread during the stitching operation.

Moreover, by providing that the shaft 2 at the upper end of eye 4 extends at an angle between about 10° and 30° from the needle axis 7, i.e., that the longitudinal axis of transition portion 10 forms an angle of between about 30° and 10° with needle axis 7, it becomes possible to provide for an increasing depth of the thread-guiding channel 5 at the region at which it merges into the eye 4 while maintaining a constant depth over the remainder of channel 5. Therefore, it is now possible to utilize sewing threads which are two-to-three thicknesses heavier than the threads which could be used with conventional sewing machine needles of the same size and yet afford complete protection thereof during the sewing operation.

Referring to FIGS. 4*a* and 4*b*, the shaft 2 of the sewing needle of the present invention has a transverse cross-section which is substantially U-shaped and in the region 4 defines a pair of parallel side walls 14 as seen in FIG. 4c. The web 17 which interconnects the two shanks 16 defining the U-shaped cross-section becomes somewhat wider towards the needle eye 4 so that the side walls 14 in the eye region will protrude on both sides above the peripheral line of the shaft cross-section.

As seen in FIGS. 4a'–4c', the cross-section of the shaft 2 may also have a substantially V-shaped configuration. In this case, the material forced from the needle eye 4 will be pressed into the side walls 14 which are somewhat wider than the thickness of the shaft 2.

It can be seen in FIGS. 4a–4c and 4a'–4c' that the ratio of shaft height to shaft width (H/S) is substantially constant for the three cross sections D,E and F in FIG. 4, which isn't the case for the prior art needle shown in FIGS. 3a–3c. This similarity in H/S ratio provides for a higher resistance to buckling than for the prior art needle as well a better loop formation during sewing.

As a result of the particular profiling of the chamfer portion 6 according to the present invention, which provides for a constant profile force which requires only a minor reduction of the width of the shaft profile only for special requirement, the needle of the invention has excellent rigidity characteristics, even where the depth of the chamfer portions 6 exceeds 60% of the nominal shaft diameter or shaft thickness. In order to assure the gripping of the needle thread, the depth of the chamfer portion 6 shculd be on the order of 50% of the thickness of the shaft 2 or 1.5 to 2 times the diameter of the sewing thread.

As illustrated in FIGS. 7, 8a and 8b, the sewing machine needle of the invention may be provided with a second thread-guiding channel 18 located above the chamfer portion 6 and on the same side thereof. Such construction is particularly advantageous for certain chain-stitching machines and "overlock" sewing machines.

The needle axis 7 of the sewing machine needle according to the present invention may also be curved in an arcuate configuration as seen in the embodiment of the invention illustrated in FIG. 9. If the radius of curvature of the needle axis is relatively large, a sufficient free space is provided for the thread-catching device through the chamfer portion 6.

Figure 5:
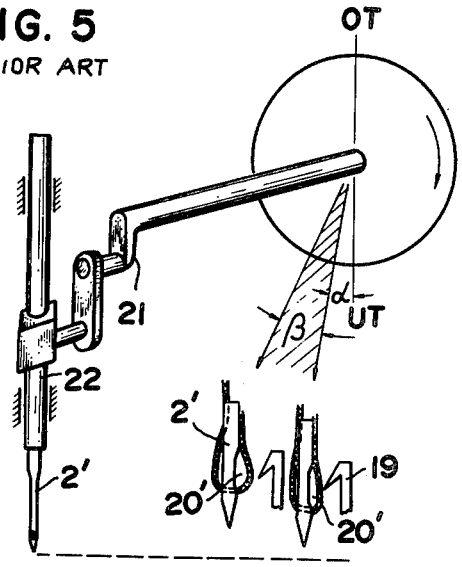
FIG. 5 PRIOR ART
FIG. 5 is a schematic view of the interspace provided by a prior art needle and the thread-catching device operatively associated with the needle and illustrates the extremely limited time period for the thread-catching operation of the device.
Figure 6:
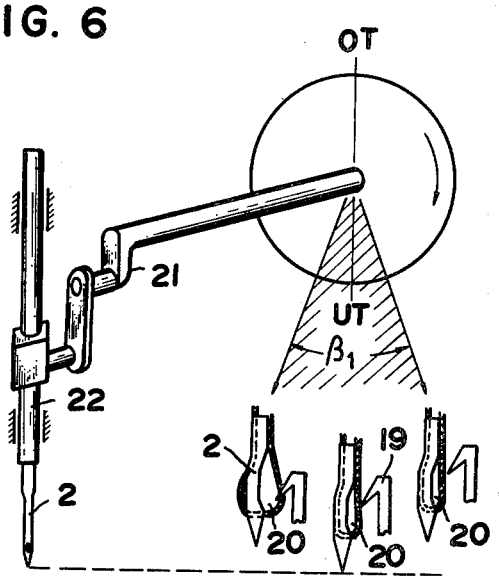
FIG. 6 is a schematic view of the interspace provided by a needle constructed in accordance with the present invention and a thread-catching device operatively associated therewith and illustrates the increase in the time period over which the thread-catching operation can be accomplished relative to the prior art.

Referring now to FIG. 5, the thread-gripping or catching operation normally encountered in sewing machines which utilize conventional sewing machine needles is illustrated. The known sewing machine needle has a chamfer portion 6' (FIG. 1) whose depth ranges from about 20% to a maximum of 30% of the thickness of the needle shaft 2'. The gripping or catching of the upper or needle thread by the thread-catching device 19 or by a shuttle is only possible if a thread loop 20' is formed as a result of the lifting of the needle. Thus, only if the crank 21 which drives needle shank 22 has passed the lower dead center position an angle $\alpha$ of at least 10° may the thread-catching device 19 engage the thread loop 20', at the earliest. This condition is illustrated by the right-most illustration of the needle and thread-catching device 19. As the crank continues to rotate through the angle $\beta$, which is approximately 15°, the thread loop 20' is further enlarged as depicted by the left-most illustration of the needle shaft 2'. It is therefore seen that only a relatively small crank angle $\beta$ is available during which the upper or needle thread can be caught by the thread-catching device 19 or similar loop catcher. Moreover, this angle becomes even considerably smaller in the case where an elastic needle thread is used. The construction of the sewing needle of the present invention advantageously permits a significant widening of the crank angle during which the needle thread can be caught relative to prior art constructions. More particularly, referring to FIG. 6, it is indicated that utilizing a needle according to the present invention, the needle thread can be gripped in a "prestressed" condition. The free space or interspace created by the chamfer portion 6 is available at the lower dead center location of the needle and even before the lower dead center position of the needle (approximately a 20° crank angle), sufficient for a reliable gripping of the needle thread without the necessity of widening this space through the lifting of the needle to form a thread loop. As a result, the crank angle through which the needle thread can be caught by the thread-catching device 19 is widened to $\beta$, which is approximately 40° of crank angle rotation, wherein about 20° of such crank angle lies prior to the lower dead center position of the crank. Thus, prior to reaching the lower dead center position, the interspace of the thread loop 20 remains constant while after the lower dead center position has been passed, the thread loop 20 widens. Because of this free thread mobility into and through the needle of the invention, the thread loop 20 is greater than the thread loop 20' of the conventional needle, assuming all other factors to be the same. This permits the utilization of larger thread catching devices with adjustable tolerances which is a significant advantage relative to conventional apparatus. The free thread movement through the needle accomplished by the present invention also facilitates the adjustment of a low thread tension at the sewing machine.

The production costs for the needle of the invention are lower than the costs of known production techniques since in the former case the extrusion molding technique utilized to accomplish a direct profiling, i.e., a profiling from a blank by means of a stamping operation to a finished or completely formed needle which requires only the provision of a point for completion. Additionally, material costs are lower as a result of the loss free shaping technique. Because of the increased rigidity and the modified coordination of the individual needle thicknesses for larger thread thicknesses, the current series of needle thicknesses can be reduced from an average of 8 per needle type to approximately ½ that number.

The needle construction of the present invention advantageously provides an improved protection for the sewing thread, the functionally critical adjustment tolerance between the needle and the thread-catching device is enlarged and the interdependent time periods to accomplish certain operations are also increased to such an extent that effective improvements for the sewing machine construction and the application of the sewing needle become possible. Additionally, the production technique for the sewing needle of the present invention is improved in a manner such that necessary construction characteristics which improve the quality of the needle can be provided in an economical fashion.

The enlargement or increase of the depth of the chamfer portion above the needle eye makes it possible to completely eliminate the loop lifting step in sewing machines and to control the thread-catching device or, respectively, gripping device in a manner such that its point engages the thread even before the needle has reached its lower dead center position. Thus, the free space which comes into existence between the needle shaft and a taut thread will always be sufficiently large that the gripping point of the thread can be reliably caught over a relatively wide range of crank angles. This interspace is also independent of the material from which the sewing thread is formed, i.e., independent of whether an elastic sewing thread is being used and is also independent of the condition as to whether the upper thread and, if necessary, the lower thread is being sewn under relatively great tension.

All of the advantageous benefits of the present invention makes it possible to considerably increase the sewing speed, to considerably simplify the construction of a sewing machine, eliminate control problems, reduce stitching time, and enable the use of elastic threads under greater tension as well as sewing threads having relatively low rigidity for sewing at higher speed.

Obviously, numerous modifications and variations of the present invention are possible in light of the above teachings. It is therefore to be understood that within the scope of the claims appended hereto, the invention may be practiced otherwise than as specifically disclosed herein.

What is claimed is:

1. In a sewing machine needle including a butt portion and a shaft connected to and extending from an end of the butt portion, said shaft terminating in a point at its free end and having an eye formed therethrough above the point, an elongate thread-guiding channel which merges into the eye formed in one side of the shaft, and a chamfer portion formed on the side of the shaft opposite to the side which said thread-guiding channel is formed, said shaft defining a needle axis, the improvement comprising:

said chamfer portion is defined by a portion of said shaft situated above said needle eye which is laterally displaced with respect to said needle axis and which extends substantially parallel thereto, said displaced shaft portion having substantially the same cross sectional configuration as defined by the ratio of shaft height to shaft width as other portions of the shaft above the needle eye, and first and second shaft transition portions extending at an angle with respect to said needle axis and adjoining said displaced shaft portion.

2. The combination of claim 1 wherein said displaced portion of said shaft is spaced a distance from said needle axis in the range of about 30% to 60% of the thickness of the shaft and where the longitudinal axes of said transition portions of said shaft form an angle of about 30° or less with said needle axis.

3. The combination of claim 1 wherein said shaft transition portions include a first shaft transition portion which extends between the region of said needle eye and one end of said displaced shaft portion and wherein said first transition portion begins at said needle eye.

4. The combination of claim 1 wherein said shaft has a substantially U-shaped transverse cross-section over its length up to the needle eye and wherein said needle eye is constituted by substantially parallel side walls which merge into said shaft.

5. The combination of claim 1 wherein said shaft has a substantially V-shaped transverse cross-section over its length up to the needle eye and wherein said needle eye is constituted by side walls which are at least slightly inclined towards each other and which merge into said shaft.

6. The combination of claim 4 wherein said needle eye side walls are wider than the thickness of said shaft.

7. The combination of claim 5 wherein said needle eye side walls are wider than the thickness of said shaft.

8. The combination of claim 1 wherein the depth of said thread-guiding channel increases at a region thereof wherein said channel merges with said needle eye.

9. The combination of claim 1 wherein said needle eye has an upper side which is defined by an upper flange, said upper flange being displaced with respect to said needle axis in the direction of the side of the shaft opposite the side in which said thread guide channel is formed.

10. The combination of claim 1 wherein said needle eye has a lower side which is defined by a lower flange, said lower flange being displaced with respect to said needle axis in the direction of the side of the shaft in which the thread guide channel is formed.

11. In a sewing machine needle including a butt portion and a shaft connected to and extending from an end of the butt portion, said shaft terminating in a point at its free end and having an eye formed therethrough above the point, an elongate thread-guiding channel which merges into the eye formed in one side of the shaft, and a chamfer portion formed on the side of the shaft opposite to the side which said thread-guiding channel is formed, said shaft defining a needle axis, the improvement comprising:

said chamfer portion is defined by a portion of said shaft situated above said needle eye which is laterally displaced with respect to said needle axis and which extends substantially parallel thereto, said displaced shaft portion having substantially the same cross sectional configuration as defined by the ratio of shaft height to shaft width as other portions of the shaft above the needle eye, first and second shaft transition portions extending at an angle with respect to said needle axis and adjoining said displaced shaft portion, said chamfer portion having a bottom constituted by an outwardly facing surface of said displaced portion of said shaft, and said chamfer portion bottom and said needle point being substantially coincident with said needle axis.

12. The combination of claim 1 wherein a second thread-guiding channel is formed in said shaft above said chamfer portion.

13. The combination of claim 1 wherein said thread-guiding channel, needle eye, and chamfer portion are formed in a single operation by means of a burrless extrusion molding technique.

14. In a sewing machine including a needle having an eye and a chamfer portion formed in the needle shaft at a location above the needle eye so as to create a free space between the needle shaft and the needle thread, and a thread loop catching device whose movement is determined by the movement of the needle and having a point which is receivable in said free space during operation of the machine, the improvement comprising:

said chamfer portion is defined by a portion of said shaft situated above said needle eye which is laterally displaced with respect to said needle axis and which extends substantially parallel thereto, said displaced shaft portion having substantially the same cross sectional configuration as defined by the ratio of shaft height to shaft width as other portions of the shaft above the needle eye, the depth of said chamfer portion is at least about 50% of the thickness of the needle shaft, and means for controlling the movement of said thread loop catching device so that the point thereof is received in said free space defined by said chamfer portion between said needle shaft and a taut thread of a thread loop associated with said needle at a time prior to or at the time when the needle has reached its lower dead center position.

* * * * *